US009353505B2

(12) United States Patent
Pilon

(10) Patent No.: US 9,353,505 B2
(45) Date of Patent: May 31, 2016

(54) EARTH WORKING BUCKET AND CONNECTOR ASSEMBLY SECURING WEAR MEMBER THERETO

(75) Inventor: Michel Pilon, Ottawa, CA (US)

(73) Assignee: GLOBAL CASTING INC., Plessisville, QC ( * ) Notice: Subject to any disclaimer, the term of this patent is extended or adjusted under 35 U.S.C. 154(b) by 97 days.

(21) Appl. No.: 14/116,235

(22) PCT Filed: May 11, 2012

(86) PCT No.: PCT/CA2012/050308

§ 371 (c)(1), (2), (4) Date: Nov. 7, 2013

(87) PCT Pub. No.: WO2012/151703

PCT Pub. Date: Nov. 15, 2012

(65) Prior Publication Data

US 2014/0082977 A1 Mar. 27, 2014

Related U.S. Application Data

(60) Provisional application No. 61/569,529, filed on Dec. 12, 2011, provisional application No. 61/484,745, filed on May 11, 2011.

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01); *E02F 9/2833* (2013.01); *Y10T 29/49948* (2015.01); *Y10T 403/7067* (2015.01)

(58) Field of Classification Search
CPC ..... E02F 3/364; E02F 9/2816; F16B 2/14
USPC ..... 403/374.3, 374.4; 37/455, 456
See application file for complete search history.

(56) References Cited

U.S. PATENT DOCUMENTS 5,410,826 A * 5/1995 Immel et al. ..... 37/457
5,452,529 A * 9/1995 Neuenfeldt et al. ..... 37/455

(Continued)

FOREIGN PATENT DOCUMENTS

| | | |
|---|---|---|
| AU | 6558396 | 3/1997 |
| CA | 2316712 | 2/2001 |
| WO | 0125551 | 4/2001 |

OTHER PUBLICATIONS

Canadian Intellectual Property Office International Search Report and Written Opinion, International Application No. PCT/CA2012/050308 dated Jul. 26, 2012 (13 pages).

*Primary Examiner* — Gary Hartmann
(74) *Attorney, Agent, or Firm* — Norton Rose Fulbright Canada; Alexandre Dagust

(57) ABSTRACT

The connector assembly is used in securing a wear member to a support structure of the earth working bucket in an engaged position in which corresponding apertures of the wear member and the support structure are aligned and form a connector passage. The connector assembly is engaged into the connector passage and comprises: an endless screw extending in the connector passage and having an externally operable head, abutment portions facing opposite walls of the connector passage, and a movement transfer mechanism operable to transform rotary movement of the endless screw into a transversal movement of one abutment portion relative the other, to push the abutment portions against corresponding opposite walls of the connector passage.

6 Claims, 5 Drawing Sheets

(56) References Cited

U.S. PATENT DOCUMENTS

| | | | | | |
|---|---|---|---|---|---|
| 5,564,206 | A * | 10/1996 | Ruvang | 37/458 |
| 5,638,621 | A * | 6/1997 | Keech et al. | 37/446 |
| 5,784,813 | A * | 7/1998 | Balassa et al. | 37/455 |
| 5,926,982 | A * | 7/1999 | Keech et al. | 37/455 |
| 5,964,547 | A | 10/1999 | Brinkley | |
| 6,009,644 | A | 1/2000 | Hedley | |
| 6,301,810 | B1 * | 10/2001 | Fidler | 37/458 |
| 7,036,249 | B2 * | 5/2006 | Mautino | 37/457 |
| 2008/0276500 | A1 | 11/2008 | Ruvang | |

* cited by examiner

EARTH WORKING BUCKET AND CONNECTOR ASSEMBLY SECURING WEAR MEMBER THERETO

FIELD

The technical field relates to removably retaining wear members to excavation equipments such as earth working buckets, and more particularly, to a connector assembly therefore which does not require hammering.

BACKGROUND

Excavation equipment, and in particular earth working buckets such as cable shovel dippers, are used, amongst others, for heavy earthwork applications such as mining and excavation and many have components which are particularly subjected to wear by friction against the earthen materials during normal use, and which are thus designed to be replaceable. Among these components, those which are perhaps the most subjected to wear are the teeth which are subjected to direct engagement against the material to be transported by the bucket. To this end, the teeth are mounted to corresponding tooth holders, but even the tooth holders are subjected to wear and must eventually be replaced. Furthermore, various replaceable shrouds can be used to protect edge portions. In this specification, replaceable wear components such as tooth holders, lip shrouds, wing shrouds, corner shrouds, etc., which are removably secured to buckets will be referred to generally as wear members.

It is known in the art to mechanically attach the wear members to an associated edge of the bucket. In many applications, a spool, often C-shaped, is vertically inserted through aligned openings defined in the wear member and the bucket, i.e. the parts to be connected, and held in place with a wedge. The wedge is forcefully hammered by a workman using a sledge hammer to jam the rear surface of the spool against the wear member and the bucket to be connected. To lock the wedge and spool together, a lip provided at an end of the wedge is typically bent down around the C-clamp thereby preventing the assembly from becoming loose and falling out of the opening. The combination is known in the art as spool and wedge assemblies.

There were inconveniences to the spool and wedge assemblies which the instant approach aims to address; in particular, the process of assembling the spool and wedge, and removing them for replacing the wear member, was quite demanding for workmen.

SUMMARY

In accordance with one aspect, there is provided a ground engaging apparatus comprising a support structure; a wear member releasably engaged over the support structure and extending along a first axis; a connector receiving passage extending through the support structure and the wear member; and a connector system extending through the connector receiving passage and releasably retaining the wear member on the support structure, the connector system comprising: a C-clamp member; an adjustment structure including a drive member mounted to the C-clamp member and a displaceable member engaged with the drive member and displaceable along a second axis upon actuation of the drive member and having an oblique surface portion; and a wedge member having an oblique surface portion abutting the oblique surface portion of the displaceable member and being displaced along the first axis upon displacement of the displaceable member along the second axis.

In accordance with another aspect, there is provided a method of engaging a wear member to a support structure, said method comprising: aligning apertures provided in the wear member and the support structure to form a connector passage; inserting a connector assembly in the connector passage, and while the connector assembly is in the connector passage, rotating an endless screw of the connector assembly, the connector assembly transforming the rotary movement of the endless screw into a transversal movement of a wedge member forcing portions of the connector assembly against opposite walls of the connector passage.

In accordance with another aspect, there is provided a connector assembly for securing a wear member to a support structure of an earth working bucket in an engaged position in which corresponding apertures of the wear member and the support structure are aligned and form a connector passage, the connector assembly being engageable into said connector passage and comprising: an endless screw extending in the connector passage and having an externally operable head when the connector assembly is engaged in the connector passage, abutment portions facing opposite walls of the connector passage when the connector assembly is engaged in the connector passage, and a movement transfer mechanism operable to transform rotary movement of the endless screw into a transversal movement of one abutment portion relative the other, to push the abutment portions against corresponding opposite walls of the connector passage.

In accordance with another aspect, there is provided a connector assembly for securing a wear member in an engaged position relative a support structure of a ground-engaging excavation apparatus, the wear member and support structure each having apertures alignable when in said engaged position to form a connector passage together for receiving the connector assembly, the connector passage having a first wall opposite a second wall, and two opposite ends, the connector assembly comprising: a body member with a first face engageable against the first wall of the connector passage, a second face opposite the first face, an internal lengthwise passage at least partially parallel to the first face and second face, and a transversal passage through said second face and leading to the lengthwise passage, and an endless screw rotatably mounted to the body member, and extending across the lengthwise displacement path, the endless screw having a head exposed to external rotation activation during use; a wedge member slidingly engaged with the transversal passage with a first end having an engagement face protruding into the lengthwise displacement path and being inclined relative to the endless screw and a second end opposite the first end; and a movement transfer member threadingly engaged with the endless screw and slidingly engaged with the lengthwise displacement path in a rotation-prevented manner, the movement transfer member having an engagement face engageable with the engagement face of the wedge member; wherein activating the endless screw head in a corresponding direction when the connector assembly is in the connector passage forces the movement transfer member against the wedge member, pushing the second end of the wedge member outwardly away from the second face, forcing the first face of the body member against the first wall.

Many further features and combinations thereof concerning the present improvements will appear to those skilled in the art following a reading of the instant disclosure.

DESCRIPTION OF THE FIGURES

In the figures.

It will be noted that throughout the appended drawings, like features are identified by like reference numerals.

DETAILED DESCRIPTION

Figure 1:
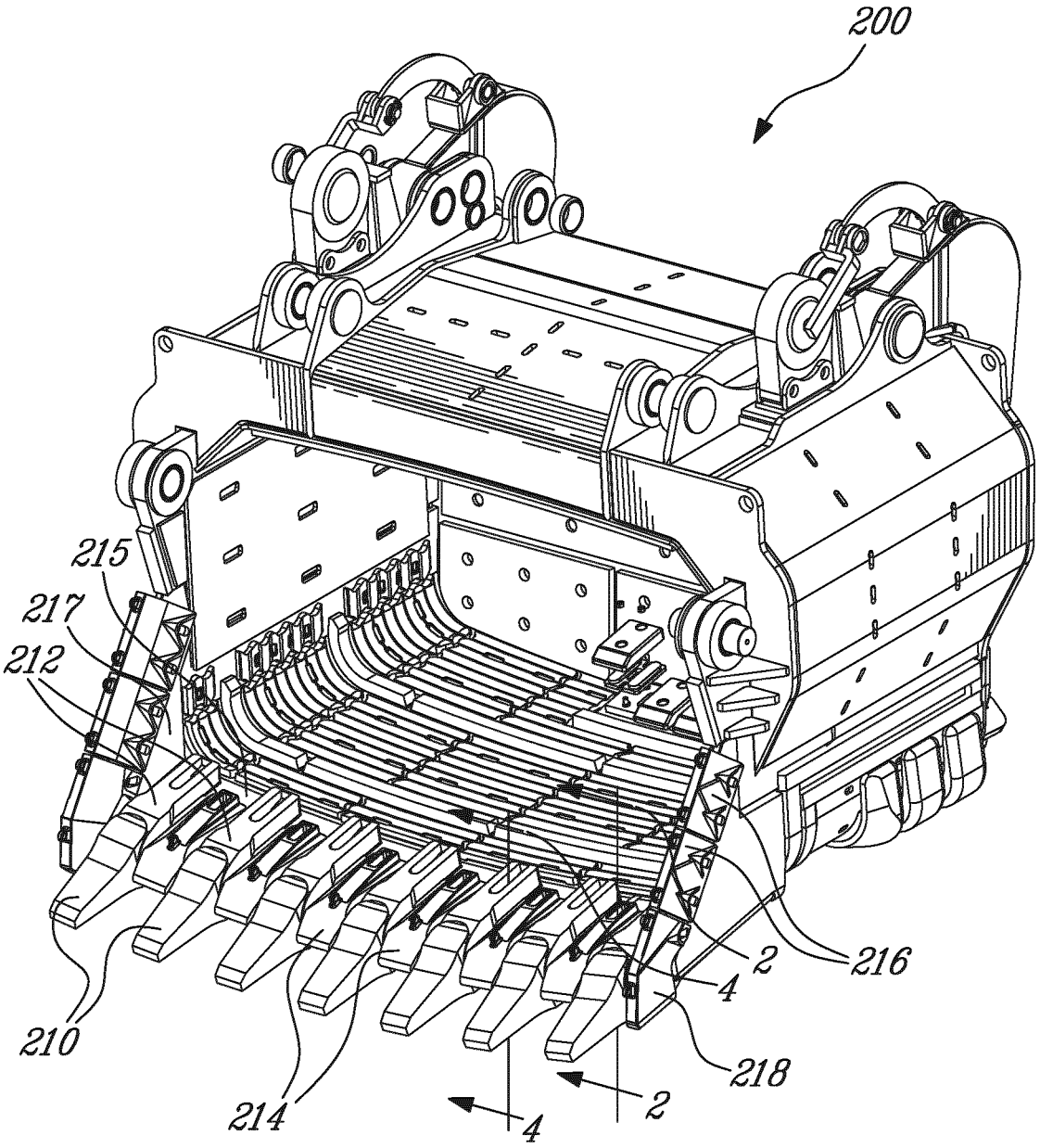
FIG. 1 is an oblique view of a cable shovel dipper.

FIG. 1 shows a cable shovel dipper 200 of the type generally used on electric-cable shovels to scoop ore from the ground. The cable shovel dipper has a plurality of components which are subjected to wear during normal use, and which are thus designed to be replaceable. Among these components, those which are perhaps the most subjected to wear are the teeth 210 which are subjected to direct engagement against the material to be transported by the dipper. To be easily replaceable, the teeth are removably mounted to corresponding tooth holders 212. However, even the tooth holders 212 are subjected to wear and must eventually be replaced. To this end, they are removably engaged with an edge portion 215 of the dipper 200. Furthermore, lip shrouds 214 are used to protect the edge portion 215 of the dipper 200 which extends between the tooth holders 212, and wing shrouds 216 and corner shrouds 218 are used to protect lateral edge portions 217 of the dipper 200, referred to as wings, and the corner portion, respectively. In this specification, replaceable wear components such as the tooth holders 212, lip shrouds 214, wing shrouds 216 and corner shrouds 218 which are removably secured to buckets will be referred to generally as wear members.

Figure 2:
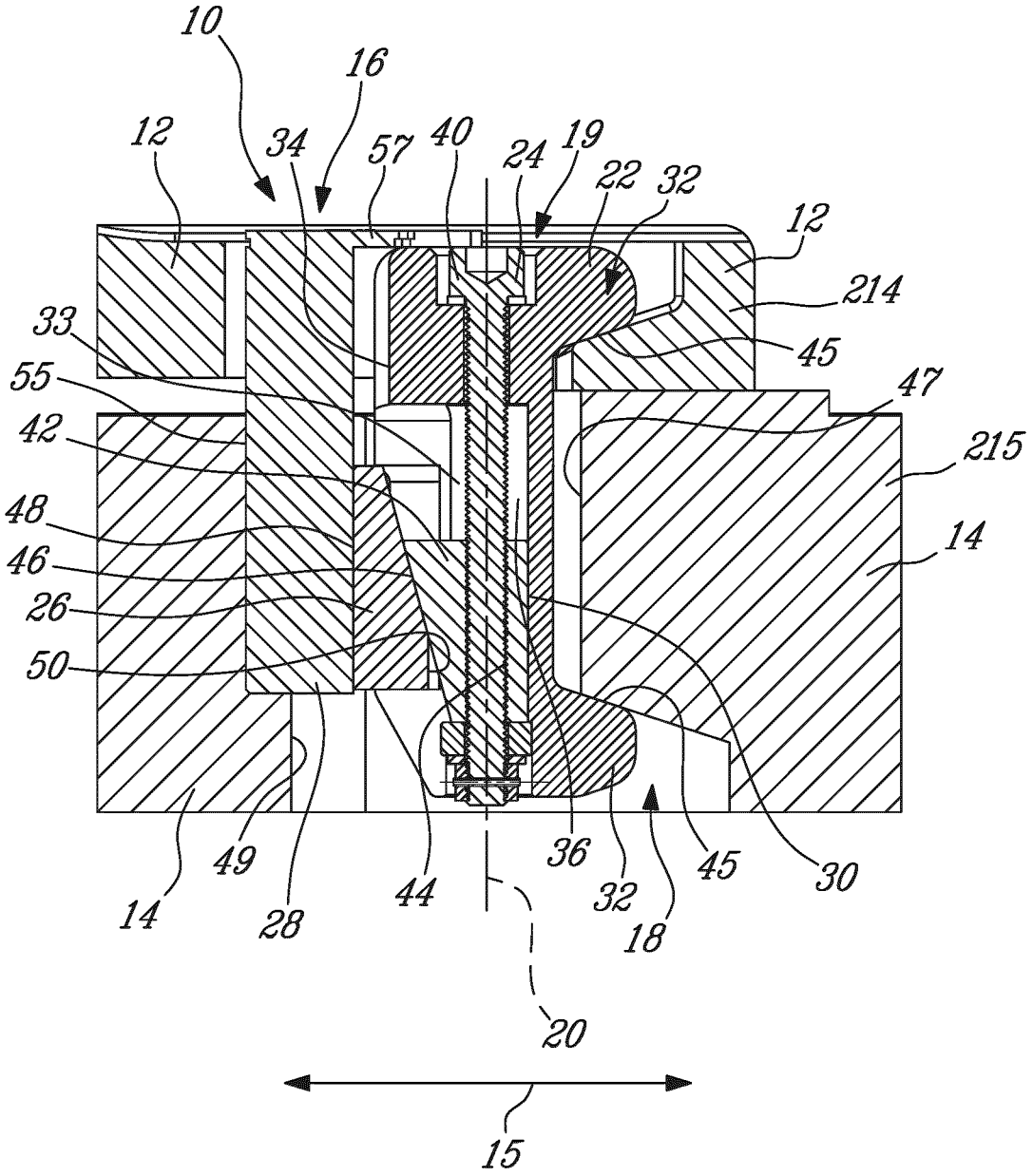
FIG. 2 is a cross-sectional view taken along cross-section lines 2-2 of FIG. 1, showing a first example of a connector assembly adapted to a lip shroud.

Referring now to the drawings and, more particularly referring to FIG. 2, there is shown a connector assembly 10 provided in the form of a hammerless C-clamp (or spool), for mechanically attaching a wear member 12 in the form of a lip shroud 214 to a support structure 14 in the form of an edge portion 215, or lip, of a cable shovel dipper 200 (see FIG. 1).

The wear member 12 is releasably engaged with the support structure 14 and is oriented in a front to rear direction along a first orientation 15 which can be referred to as transversal. The expression transversal is used liberally herein to indicate a general orientation, and is not necessarily perpendicular to longitudinal, for instance. Each one of the wear member 12 and the support structure 14 has a respective opening 16, 18 defined therein. The connector assembly 10 is removably insertable into the aligned openings 16, 18 defining a connector receiving passage 19 through the wear member 12 and the support structure 14. The openings 16, 18 extend along a second axis 20 which can be roughly perpendicular to the transversal orientation 15.

Figure 3:
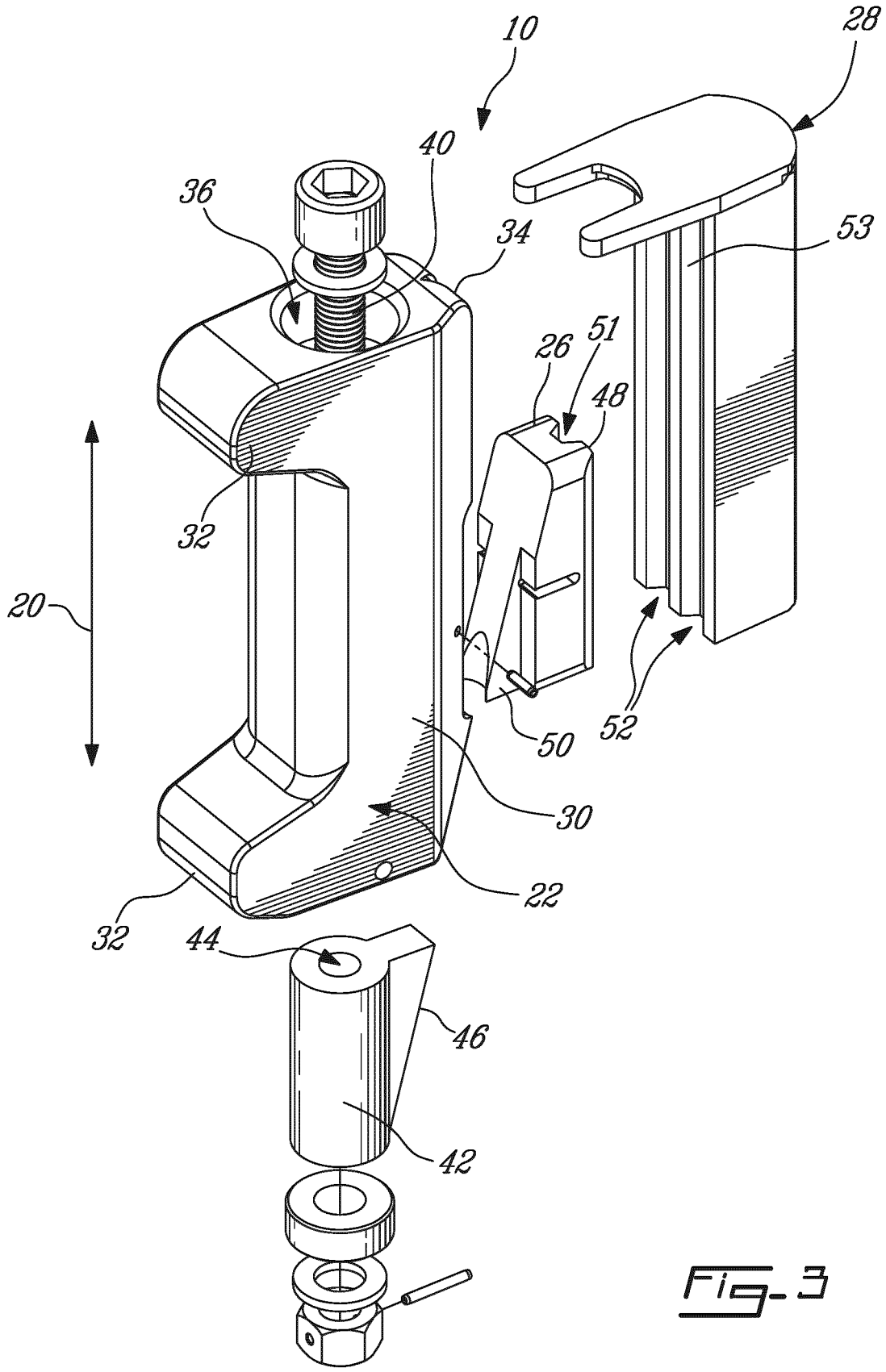
FIG. 3 is an exploded view of the connector assembly shown in FIG. 2.

The connector assembly 10 is shown alone in FIG. 3. The connector assembly includes a body member 22 provided in this embodiment in the form of a C-clamp member, an adjustment structure 24, a wedge member 26, and a spacer 28.

The body member 22 is generally C-shaped and, as mentioned above, is often referred to as a spool. It has an elongated body 30 with two projections 32 extending transversally at its opposed ends on a rear side thereof. The body member 22 has an elongated port 33 on a front side 34 communicating with an internal channel 36 extending therethrough. In the embodiment shown the front side 34 of the bodymember 22 further includes two spaced-apart ribs projecting forwardly.

When the body member 22 is inserted in the connector passage 19, the rearwardly extending projections 32 respectively extend along corresponding sloped surfaces of the superposed wear member 12 and support structure 14 and collectively forming a rear abutment portion 45 in contact with a corresponding portion of a rear wall 47 of the connector passage 19, and further squeezing the wear member 12 and support structure 14 against one another by way of the sloping faces when pushed transversally thereagainst.

The adjustment structure 24 includes an endless screw 40 extending through the internal channel 36 of the body member 22 and a displaceable member 42, referred to herein as a movement transfer member, having a threaded bore 44 defined therein. The displaceable member 42 is engaged with the endless screw 40. More particularly, the endless screw 40 extends through the treaded bore 44 of the displaceable member 42. The internal channel 36 forms a longitudinal passage with walls oriented parallel to the axis of the endless screw 40 which allows lengthwise displacement of the displaceable member 42, but which also cooperates with the displaceable member 42 and prevents it from rotating; the displaceable member 42 thus being forced by the longitudinal passage into lengthwise displacement along the endless screw 40 upon rotation thereof. The endless screw 40 is rotatably mounted to the body member 22 by a conventional assembly including nuts and spacers as it is known in the art. The connector assembly 10 is configured in a manner that the head of the endless screw 40 be operable externally when the connector assembly 10 is inserted into the connector passage 19.

In the embodiment shown, the endless screw 40 has an hexagonal key head. However, one skilled in the art will appreciate that other mechanical actuators can be used.

The displaceable member 42 has an oblique surface portion 46, the oblique surface portion 46 being oblique with respect to the axis of the endless screw 40. More particularly, the displaceable member 42 has a thick portion at an upper end and a thin portion at an opposed lower end in this case.

The displaceable member 42 is also located in the internal channel 36 of the body member 22 with the oblique surface portion 46 extending through the elongated port 33 defined on the front side 34 of the body member 22 and protruding outwardly therefrom. Therefore, the oblique surface portion 46 is displaceable in the elongated port 33, between the two spaced-apart ribs 38, upon rotation of the endless screw 40. The displaceable member 42 does not rotate when the endless screw 40 is rotated.

A wedge member is also received in the body member 22, in a manner to be snugly transversally displaceable by a transversal passage formed in elongated port 33. The wedge member 26 has a front side surface 48, extending generally parallel to the second axis 20, and an opposed oblique rear side surface 50 abutting the oblique surface portion 46 of the displaceable member 42. In the embodiment shown, the oblique surface portion 46 of the displaceable member 42 and the oblique rear side surface 50 of the wedge member 26 are complementary to one another, i.e. they define the same angle with the second axis 20 in opposed directions. More particularly, the upper end of wedge member 26 is thinner than the lower end. In the embodiment shown, the angle defined between the oblique surface portion 46 and the oblique rear side surface 50 with the second axis 20 is about 15 degrees.

However, one skilled in the art will appreciate that this angle can be varied. The front side surface 48 has an elongated groove 51 defined therein, the purpose of which will be described below.

Henceforth, a movement transfer mechanism is formed such that when the head of the endless screw 40 is rotated, the rotary movement of the endless screw 40 is transformed into a transversal linear movement of the wedge member, via the transversal passage and longitudinal passage, and the mating sloping engagement faces of the wedge member 26 and the displaceable member 42.

The spacer 28 is inserted in the connector receiving passage 19 forwardly of the body member 22 and the wedge member 26. The spacer is optional, but can help in reducing the required travel distance of the wedge member 26 for the connector assembly to be functional (i.e. be both insertable into the connector passage 19 and operable to push opposite walls of the connector passage once inside). The spacer 28 bears a corresponding abutment portion 55 of the connector assembly 10 which abuts a front wall 49 of the connector receiving passage 19 when it is pushed upon by the front side surface 48 of the wedge member 26, forcing the abutment portion 55 and the abutment portion 45 in opposite directions. As it will be described in more details below, the thickness of the spacer 28 is adjusted in accordance with the size of the connector receiving passage 19. One skilled in the art will appreciate that, in an embodiment, the connector assembly 10 could be free of spacer 28 and the front side surface 48 of the wedge member 26 could abut directly the front wall 49 of the connector receiving passage 19.

In order to install the connector assembly 10 in the connector receiving passage 19, some clearance is required in the connector receiving passage 19. Therefore, when the body member 22, the adjustment structure 24, and the wedge member 26 are in place, there is a gap between the wedge member 26 and the front face of the connector receiving passage 19. To reduce the horizontal travel required to push the body member 22 against the wear member 12 and the support structure 14, the spacer 28 is inserted between the wedge member 26 and the front face of the connector receiving passage 19. Spacers 28 of different thicknesses can be made available to be selected as a function of the remaining gap. In this particular embodiment, the spacer 28 has a stop 57 at an upper end thereof which comes into abutment with an upper end of the connector body 22 to prevent the spacer 28 from falling through the connector passage 19 upon insertion. If used, the stop 57 should be shaped in a manner to allow free access to the head of the endless screw 40. Alternately, the shape of the connector passage 19 can be formed in a manner to receive the spacer 28 and prevent it from falling through, for instance.

In this embodiment, the spacer 28 has a rear side surface having two elongated grooves 52 extending parallel to one another and an elongated rib 53 extending therebetween. Mating features provided at the front side surface 48 of the wedge member 26 and of the body member 22 are engaged in groove and tongue relationship with these grooves 52 and rib 53 on the rear side surface of the spacer 28 to ensure a firm lateral engagement. More particularly, the elongated rib 53 of the spacer 28 is engaged in the elongated groove 51 defined in the front side surface 48 of the wedge member 26.

The connector assembly 10 is inserted in the connector receiving passage 19 in a contracted configuration wherein the oblique rear side surface 50 is entirely superposed to the oblique surface portion 46 of the displaceable member 42 with the thick portion of the wedge member 26 superposed to the thin portion of the displaceable member 42 and vice-versa (i.e. the endless screw 40 is rotated in one direction to move the displaceable member 42 fully upward and the wedge member 26 is pushed into the port 33). The thickness of the spacer 28 is selected in a manner such that the length of the assembly 10 substantially corresponds to the length of the connector receiving passage 19 along the longitudinal axis 15.

When the endless screw 40 is rotated in the appropriate direction, the displaceable member 42 moves downwardly along the screw 40 and is displaced relatively to the wedge member 26. By displacing the displaceable member 42, the thick portion of the displaceable member 42 abuts a thicker portion of the wedge member 26. Thus the wedge member 26 translates along the longitudinal axis 15 and applies pressure on the spacer 28 and the front end of the connector receiving passage 19. Thus, the connector assembly 10 expands from the contracted configuration, i.e. its length increases along the longitudinal axis 15. Via the resulting sliding interaction between the displaceable member 42 and wedge member 26, such downwardly driven movement of the displaceable member 42 relative to the stationary body member 22 horizontally expands the connector assembly 10 in a rearward direction, forcing the body member 22 rearwardly to tighten the wear member 12 on the support structure 14 and releasably retain the connector assembly 10 in place within the openings 16, 18 to thereby hold the wear member 12 on the support structure 14.

Thus, when the wedge member 26 is displaced horizontally relatively to the body member 22, it abuts against the spacer 28 extending at the front end of the connector receiving passage 19. The horizontal displacement is produced by moving down the displaceable member 42 with the endless screw 40. More particularly, when the hexagonal head cap screw 40 is torque from above in an upper portion of the body member 22, it pushes down on the displaceable member 42 which transfers the force horizontally to the wedge member 26. In an embodiment, the hexagonal head cap screw 40 can be rotated with a torque wrench. The screw 40 is rotated until the adapter 12 is tightly in place against the edge of the structural member 14.

With the connector assembly 10, only an horizontally oriented force is applied to the body member 22. To generate the horizontal force, the adjustment structure 24 is installed inside the body member 22 and two members 26, 42 having angular faces are in contact.

The tightening action of the connector assembly 10 may be employed both in the initial installation of the wear member 12 on the support structure 14, and after their interface areas wear away after use. By rotating the endless screw 40 in the opposite direction, the displaceable member 42 is moved upwardly relative to the body member 22, thereby permitting the connector assembly 10 to be laterally contracted so that it can be removed from the openings 16, 18 to permit removal of the wear member 12 from the support structure 14.

To facilitate the configuration of the assembly 10 between the contracted and the expanded configurations, the components of the assembly 10 including the body member 22, the adjustment structure 24 with the endless screw 40 and the displaceable member 42, and the wedge member 26 can be lubrified. Lubrification facilitates insertion of the assembly in the connector receiving passage 19 as well as configuration of the assembly 10.

One skilled in the art will appreciate that the assembly 10 is configurable in a plurality of expanded configurations depending on the length of the connector receiving passage 19 along the longitudinal axis 15 in which the assembly 10 is inserted.

A variety of modifications can be made to the representatively illustrated connector assembly 10 without departing from principles of the present invention.

For instance, the oblique surfaces of the displaceable member 42 and the wedge member 26 can be reversed. Thus, for expanding the assembly 10, the screw 40 should be rotated to displace the displaceable member upwardly.

Figure 4:
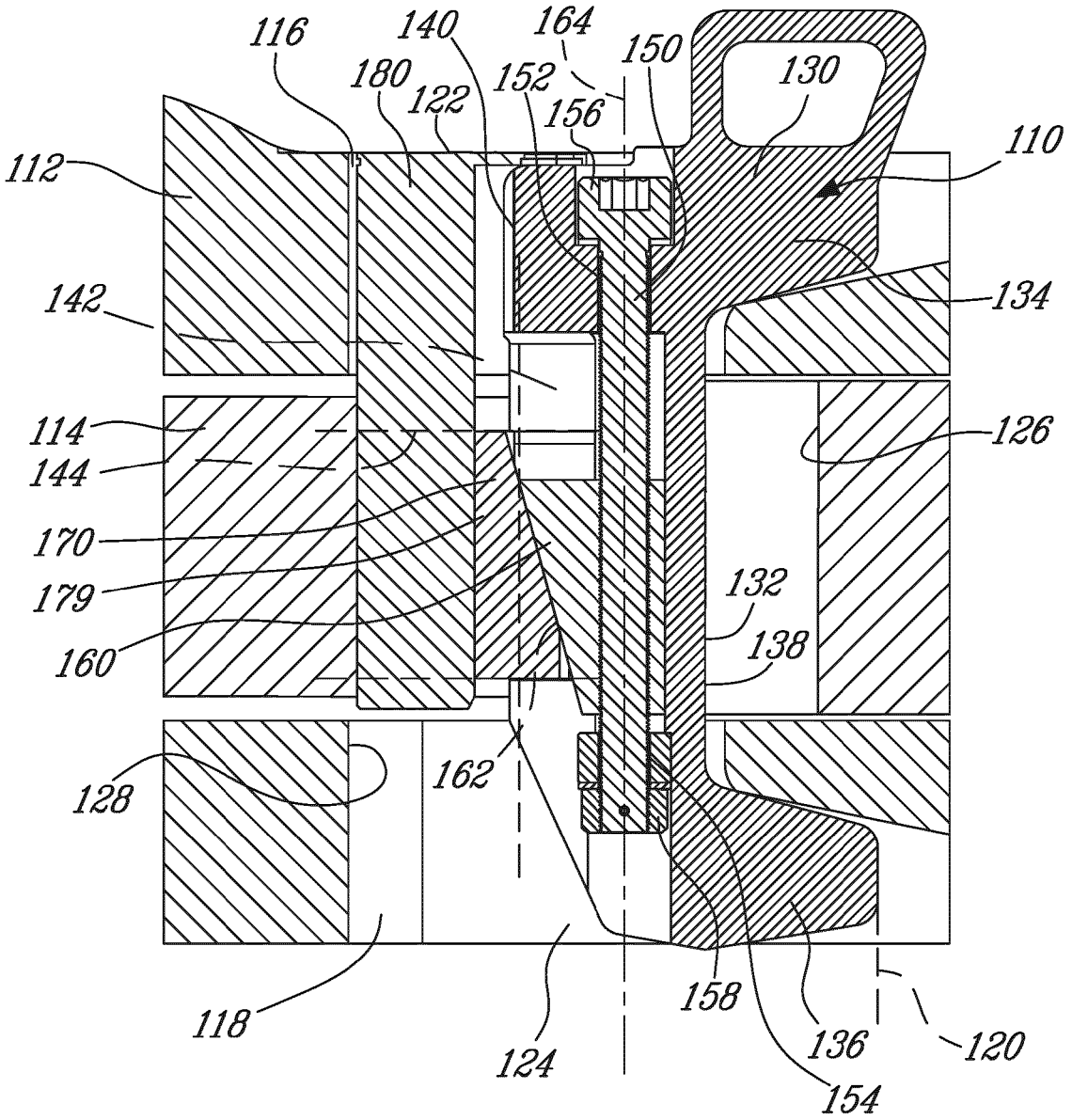
FIG. 4 is a cross-sectional view taken along cross-section lines 4-4 of FIG. 1, showing a second example of a connector assembly adapted to a tooth holder.
Figure 5:
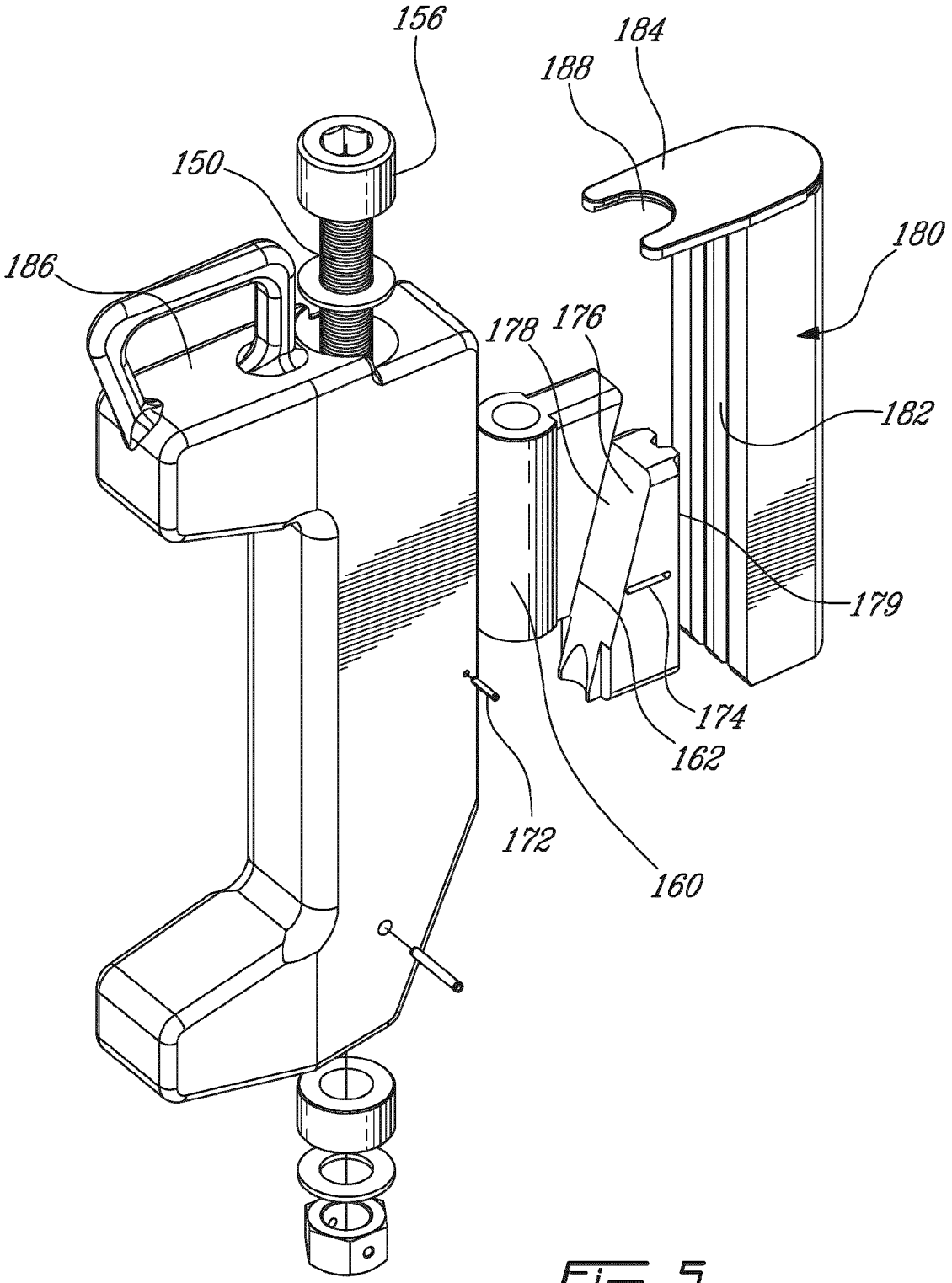
FIG. 5 is an exploded view of the connector assembly shown in FIG. 4.

FIGS. 4 and 5 show another embodiment of a connector assembly 110 securing a wear member 112 to a support structure 114 of an excavation equipment (in this embodiment, the wear member is a tooth holder). In FIG. 4 the connector assembly 110 is shown in an engaged position whereas in FIG. 5 it is shown alone.

The wear member 112 has a wear member aperture 116 and the support structure 114 has a support structure aperture 118 which are both aligned with one another to form a connector passage 120 when in the engaged position. The connector passage 120 can be said to have two opposite ends 122, 124, and a first wall 126 opposite a second wall 128. The connector assembly 110 is received in the connector passage 120.

The connector assembly 110 has a body member 130 with a first face 132 engageable against the first wall 126 of the connector passage. More particularly, in this embodiment, the first face 132 includes two protruding abutment members 134, 136 at opposite ends of an intermediate section 138 which each come into abutment with a corresponding end of the first wall 126, forcing the wear member 112 against the support structure 114 in a sandwich-like manner. The C-shaped body 130 has a second face 140 opposite the first face 132. The C-shaped body 140 has two distinct and cooperating internal passages: an internal lengthwise passage 142 at least partly parallel to the first face 132 and second face 140, corresponding to the axis of an endless screw 150 extending thereacross, and a transversal passage 144 extending through the second face 140 and leading to the lengthwise passage 142. The interaction will be detailed below.

An endless screw 150 is rotatably mounted to the C-shaped body, and extends across the lengthwise displacement path 142. The rotatable mounting of the endless screw 150 includes that it is received through bores 152, 154 which communicate with the lengthwise displacement path 142. The endless screw 150 is left free to rotate, but is prevented from being lengthwisely displaced. This is achieved in this embodiment by the head 156 of the endless screw 150, at one end, and with a footer 158 arrangement performing a similar retaining function at the other end, both of which cannot penetrate into the corresponding bore 152, 154. The head 156 of the endless screw 150 is exposed when the connector assembly 110 is in place to allow its external activation by a corresponding tool. The type of head and the corresponding tool are selected to allow imparting a sufficient amount of torque given the specific application in mind.

A movement transfer member 160 is threadingly engaged with the endless screw 150 and slidingly engaged with the lengthwise displacement path 142 in a rotation-prevented manner—i.e. the presence of the features of the C-shaped body 130 prevent the movement transfer member 160 to rotate as the endless screw 150 is rotated, thereby forcing it to move lengthwisely along the length of the endless screw 150. The movement transfer member 160 has a sloping engagement face 162 facing opposite the engagement face 132 of the C-shape body 130, and inclined relative the screw axis 164.

A wedge member 170 is slidingly engaged with the transversal passage 144. Given the particular configuration of the C-shape body 130 in this embodiment, the transversal movement in this case is further guided by the use of pin 172 and groove 174 sliding engagements more clearly shown in FIG. 5. The wedge member 170 has a first end 176 having an engagement face 178 protruding into the lengthwise displacement path 142 and being engageable with the engagement face 162 of the movement transfer member 160. To this end, it can be inclined with the same angle (complementary) than the engagement face 162 of the movement transfer member 160. A second end 179 of the wedge member 170 protrudes from the second face 140.

Henceforth, when the endless screw 150 is rotated via its head 156 the movement transfer member 160 can move downwardly, and interact with the wedge member 170 via the engaged sloping faces 162, 178 to convert the rotary torque into a transversal force exerted by the second end 179 of the wedge member 170. This force can be applied against the second wall 128 of the connector passage 120, either directly or indirectly, to push the first face 132 of the C-shaped body 130 into engagement with the first wall 126.

In this particular embodiment, a spacer member 180 is used between the second end 179 of the wedge member 170 and the second wall 128. To ease manipulation of the spacer member 180, the spacer member can have an inner face 182 shaped to form a mating sliding engagement with the second face 140 of the C-shaped body 130 such that both can easily be held against one another when the movement transfer member 160 is moved upwardly and the wedge member 170 is allowed to recess into the transversal passage 144. In this embodiment, manipulation can further be eased by the presence of a sliding ledge 184 at the upper end of the spacer 180. The sliding ledge 184 abuts against the upper end 186 of the C-shape body 130 as the connector assembly 110 is inserted into the aperture 122, which prevents the spacer 180 from sliding downwardly and out the other end 124 of the connector passage 120. Further, the sliding ledge 184 can have an elongated access aperture 188 which can allow access to the head 156 of the screw 150 for a multiplicity of transversal positions of the wedge member 170 and spacer 180. During use, the spacer member 180 receives the push from the wedge member 170 and abuts against the second wall 128, thereby allowing to force the first face 132 of the body member 130 into engagement against the first wall 126 with a limited amount of transversal displacement.

It will be understood that alternate connector assemblies can be adapted to other wear members of excavation equipment, such as wing shrouds and corner shrouds, for instance.

The examples described above and illustrated are intended to be exemplary. The scope is indicated by the appended claims.

What is claimed is:

1. A connector assembly for securing a wear member to a support structure of an earth working bucket in an engaged position in which corresponding apertures of the wear member and the support structure are aligned and form a connector passage, the connector assembly being engageable into said connector passage and comprising:

an endless screw extending in the connector passage, the endless screw having an externally operable head and being free to rotate, trapped and prevented from lengthwise displacement when the connector assembly is engaged in the connector passage, abutment portions facing opposite walls of the connector passage when the connector assembly is engaged in the connector passage, and a movement transfer mechanism operable to transform rotary movement of the endless screw into a transversal movement of one abutment portion relative the other, to push the abutment portions against corresponding opposite walls of the connector passage.

2. The connector assembly of claim 1, wherein movement transfer mechanism includes a movement transfer member threadingly engaged along the endless screw, a longitudinal passage formed inside a body member of the connector assembly, in which the movement transfer member is prevented from rotating and thus forced to move along the endless screw upon rotation thereof, and a transversal passage snugly guiding a wedge member into transversal movement, the wedge member having a sloping engagement face engageable against a corresponding sloping engagement face of the movement transfer member such that the wedge member can be forced outwardly as the movement transfer member is moved longitudinally.

3. The connector assembly of claim 2 wherein the engagement face of the wedge member is oblique and complementary to engagement face of the movement transfer member.

4. The connector assembly of claim 2 wherein the connector assembly further comprises a spacer member extending parallel to the body member, receiving an end of the wedge member opposite the sloping engagement face of the wedge member as it is forced outwardly, the body member and the spacer member bearing corresponding ones of the abutment portions.

5. The connector assembly of claim 4 wherein the spacer member has a ledge which rests on the body member as the endless screw is rotated, preventing the spacer member from falling out from engagement with the wedge member during use.

6. The connector assembly of claim 1 wherein the body member is C-shaped with the first face having two protrusions opposite an intermediary section, each protrusion being engageable against a corresponding end of the first wall, the protrusions collectively forming a corresponding one of the abutment portions.

* * * * *